US010753360B2

(12) United States Patent
Bou Dargham et al.

(10) Patent No.: US 10,753,360 B2
(45) Date of Patent: Aug. 25, 2020

(54) SCROLL COMPRESSION DEVICE HAVING A SEALING DEVICE, AND SCROLL COMPRESSOR INCLUDING SUCH A SCROLL COMPRESSION DEVICE

(71) Applicant: Danfoss Commercial Compressors, Trevoux (FR)

(72) Inventors: Remi Bou Dargham, Villeurbanne (FR); David Genevois, Cailloux sur Fontaine (FR); Dominique Gross, Jassans Riottier (FR)

(73) Assignee: Danfoss Commercial Compressors, Trevoux (FR)

( * ) Notice: Subject to any disclaimer, the term of this patent is extended or adjusted under 35 U.S.C. 154(b) by 259 days.

(21) Appl. No.: 16/071,155

(22) PCT Filed: Feb. 15, 2017

(86) PCT No.: PCT/EP2017/053385
§ 371 (c)(1),
(2) Date: Jul. 19, 2018

(87) PCT Pub. No.: WO2017/140718
PCT Pub. Date: Aug. 24, 2017

(65) Prior Publication Data

US 2019/0323502 A1 Oct. 24, 2019

(30) Foreign Application Priority Data

Feb. 16, 2016 (FR) ..... 16 51234

(51) Int. Cl.
*F01C 19/08* (2006.01)
*F04C 18/02* (2006.01)
(Continued)

(52) U.S. Cl.
CPC ..... *F04C 27/005* (2013.01); *F01C 19/08* (2013.01); *F04C 18/0215* (2013.01);
(Continued)

(58) Field of Classification Search
CPC ..... F01C 19/05; F01C 19/08; F04C 18/0284; F04C 27/005
See application file for complete search history.

(56) References Cited

U.S. PATENT DOCUMENTS 4,453,899 A * 6/1984 Hiraga ..... F01C 19/08 277/399
5,122,041 A * 6/1992 Yokota ..... F04C 27/005 418/55.4
(Continued)

FOREIGN PATENT DOCUMENTS

CN 85205644 U 2/1987
CN 1399073 A 2/2003
(Continued)

OTHER PUBLICATIONS

Machine translation of JPH05-087065A, Applicant Kubota Corp, Published 19930406. (Year: 1993).*
(Continued)

*Primary Examiner* — Mary Davis
(74) *Attorney, Agent, or Firm* — McCormick, Paulding & Huber PLLC

(57) ABSTRACT

The scroll compression device includes a first scroll element (11) having a first base plate (13) and a first spiral wrap (14); a second scroll element (12) having a second base plate (15) and a second spiral wrap (16), one of the first and second scroll elements (11, 12) being configured to perform an orbiting movement in relation to the other one of the first and second scroll elements, the first and second scroll elements (11, 12) intermeshing with each other and delimiting com-
(Continued)

pression chambers (17); and a sealing device (28) arranged in an end face (19) of the first spiral wrap (14) and having a sealing surface configured to cooperate with the second base plate (15). The sealing device (28) is configured to allow fluid flow from an upstream compression chamber to a downstream compression chamber through the sealing surface when the pressure in the upstream compression chamber exceeds the pressure in the downstream compression chamber, and the sealing device (28) is configured to prevent fluid flow from a downstream compression chamber to an upstream compression chamber through the sealing surface when the pressure in the downstream compression chamber exceeds the pressure in the upstream compression chamber.

20 Claims, 5 Drawing Sheets

(51) Int. Cl.
*F04C 29/00* (2006.01)
*F04C 27/00* (2006.01)
*F04C 23/00* (2006.01)

(52) U.S. Cl.
CPC ..... *F04C 18/0284* (2013.01); *F04C 23/008* (2013.01); *F04C 29/0035* (2013.01)

(56) References Cited

U.S. PATENT DOCUMENTS

| | | | | |
|---|---|---|---|---|
| 8,967,986 | B2 * | 3/2015 | Harashima | F01C 19/005 277/357 |
| 10,167,867 | B2 * | 1/2019 | Asami | F04C 18/0284 |
| 2004/0042911 | A1 | 3/2004 | Hong et al. | |
| 2013/0071279 | A1 * | 3/2013 | Lizuka | F01C 19/08 418/55.2 |
| 2019/0353162 | A1 * | 11/2019 | Ishii | F01C 19/005 |

FOREIGN PATENT DOCUMENTS

| | | | |
|---|---|---|---|
| CN | 102003391 | A | 4/2011 |
| CN | 102313018 | A | 1/2012 |
| DE | 4326627 | A1 | 2/1995 |
| EP | 1279835 | A2 | 1/2003 |
| GB | 2503723 | A | 1/2014 |
| JP | S5898687 | A | 6/1983 |
| JP | H0311101 | A | 1/1991 |
| JP | H0587065 | A | 4/1993 |
| JP | H0696961 | B2 | 11/1994 |

OTHER PUBLICATIONS

International Search Report for PCT Serial No. PCT/EP017/053385 dated Apr. 21, 2017.

* cited by examiner

SCROLL COMPRESSION DEVICE HAVING A SEALING DEVICE, AND SCROLL COMPRESSOR INCLUDING SUCH A SCROLL COMPRESSION DEVICE

CROSS-REFERENCE TO RELATED APPLICATIONS

This application is a National Stage application of International Patent Application No. PCT/EP2017/053385, filed on Feb. 15, 2017, which claims priority to French Patent Application No. 1651234, filed on Feb. 16, 2016, each of which is hereby incorporated by reference in its entirety.

TECHNICAL FIELD

The present invention relates to a scroll compression device, and in particular to a scroll refrigeration compression device.

BACKGROUND

A scroll compressor may include in a known manner:

- a scroll compression device including a fixed scroll element having a fixed base plate and a fixed spiral wrap extending from the fixed base plate, and an orbiting scroll element having an orbiting base plate and an orbiting spiral wrap extending from the orbiting base plate, the orbiting scroll element being configured to perform an orbiting movement in relation to the fixed scroll element, the fixed and orbiting scroll elements intermeshing with each other and delimiting compression chambers,
- a sealing device arranged in an end face of the fixed spiral wrap of the fixed scroll element and having a sealing surface sealingly cooperating with the orbiting base plate of the orbiting scroll element,
- a sealing device arranged in the end face of the orbiting spiral wrap of the orbiting scroll element and having a sealing surface sealingly cooperating with the fixed base plate of the fixed scroll element,
- a drive shaft configured to drive the orbiting scroll element in an orbiting movement,
- at least one bypass passage arranged to communicate an intermediate pressure chamber with a discharge pressure chamber, and
- at least one bypass passage valve, also named intermediate discharge valve, provided on the fixed base plate of the fixed scroll element and movable between a closing position in which the at least one bypass valve closes the at least one bypass passage and an opening position in which the at least one bypass valve opens the at least one bypass valve bypass passage.

When the at least one bypass valve is subject, on its face directed towards the fixed base plate of the fixed scroll element, to a pressure below the pressure in the discharge pressure chamber, the at least one bypass valve is maintained in the closing position and isolates the intermediate pressure chamber from the discharge pressure chamber. In this case, the compression rate, also named pressure ratio (ratio between the pressure at the discharge outlet of the scroll compressor and the pressure at the suction inlet of the scroll compressor), of the scroll compressor is maintained at its maximum value.

When the at least one bypass valve is subject, on its face directed towards the fixed base plate of the fixed scroll element, to a pressure above the pressure in the discharge pressure chamber, the at least one bypass valve resiliently deforms towards the opening position and puts the intermediate pressure chamber in communication with the discharge pressure chamber. Therefore at least a portion of the refrigerant compressed in the scroll compression device is discharged towards the discharge pressure chamber through the at least one bypass passage before this portion of the refrigerant reaches a discharge port located at a center portion of the fixed and orbiting scroll elements.

Consequently, the presence of the at least one bypass passage and of the at least one bypass valve allows to reduce, depending on the seasons, the pressure ratio of scroll compression device, and consequently to limit overcompression of the refrigerant. Such a limitation of the refrigerant overcompression improves the energy efficiency of the scroll compression device.

However, the presence of the at least one bypass passage and of the at least one bypass valve significantly increases the global cost of the scroll compression device, and requires an adjustment of the displacement of the scroll compression device. Further the installation of the at least one bypass valve on the fixed scroll element could be difficult.

Furthermore, the at least one bypass passage can only be optimized for a specific pressure ratio, and does not allow a wide efficiency optimization of the scroll compressor for all its operating conditions. Moreover, the discharge section of the at least one bypass passage is limited, and thus does not allow an optimal limitation of the overcompression of the refrigerant.

Moreover, the presence of the at least one bypass passage could decrease the stiffness of the fixed scroll element which generally includes said at least one bypass passage, or leads to an increase of the mass of the fixed scroll element to keep the same stiffness.

SUMMARY

It is an object of the present invention to provide an improved scroll compression device which can overcome the drawbacks encountered in conventional scroll compression devices.

Another object of the present invention is to provide a scroll compression device which has an improved reliability and low global cost compared to the conventional scroll compression devices, and which allows to adjust the compression rate without adjusting the displacement of the scroll compression device.

According to the invention such a scroll compression device includes at least:

- a first scroll element having a first base plate and a first spiral wrap extending from the first base plate,
- a second scroll element having a second base plate and a second spiral wrap extending from the second base plate, at least one of the first and second scroll elements being configured to perform an orbiting movement in relation to the other one of the first and second scroll elements, the first and second scroll elements intermeshing with each other and delimiting compression chambers,
- a sealing device arranged in an end face, also named tip face, of the first spiral wrap of the first scroll element and having a sealing surface configured to cooperate with the second base plate of the second scroll element,
- wherein the sealing device is configured to allow fluid flow from an upstream compression chamber to a downstream compression chamber through the sealing surface when the pressure in the upstream compression chamber exceeds the pressure in the downstream compression chamber, and the sealing device is configured to prevent fluid flow from a downstream compression chamber to an upstream compression chamber through the sealing surface when the pressure in the downstream compression chamber exceeds the pressure in the upstream compression chamber.

Such a configuration of the sealing device ensures a leakage of the refrigerant from an upstream compression chamber to a downstream compression chamber when the pressure in the upstream compression chamber exceeds the pressure in the downstream compression chamber, and thus allows to adjust the compression rate, i.e. the pressure ratio, of the scroll compression device and to avoid an overcompression of the refrigerant.

Further the sealing device is self-actuated by pressure balance between the compression chambers and the discharge port, and thus no external actuator is needed to actuate the sealing device. Such a configuration of the sealing device also avoids the use of intermediate discharge valves and the provision of bypass passages on the scroll elements, and therefore significantly decreases the global cost of the scroll compression device.

In the present specification, the wordings "upstream" and "downstream" are relative to the flow direction of the refrigerant in the scroll compression device during compression operation, i.e. from the periphery of the first and second scroll elements towards the center portion of the first and second scroll elements.

The scroll compression device may also include one or more of the following features, taken alone or in combination.

According to an embodiment of the invention, the first spiral wrap includes an inner face directed towards a center portion of the first base plate, and an outer face opposite to the inner face and directed towards an outer periphery of the first base plate, the sealing device being configured to allow fluid flow from an upstream compression chamber inwardly delimited by the outer face of the first spiral wrap to a downstream compression chamber outwardly delimited by the inner face of the first spiral wrap and through the sealing surface when the pressure in the upstream compression chamber exceeds the pressure in the downstream compression chamber.

According to an embodiment of the invention, the first scroll element is a fixed scroll element and the second scroll element is an orbiting scroll element.

According to another embodiment of the invention, the first scroll element is an orbiting scroll element and the second scroll element is a fixed scroll element.

According to another embodiment of the invention, the first and second scroll elements are configured to co-orbit, i.e. to each perform an orbiting movement.

According to another embodiment of the invention, the sealing surface is movable between a closing position in which the sealing surface sealingly cooperates with the second base plate and an opening position in which the sealing surface is distant from the second base plate, the sealing surface being configured to move towards the opening position when the pressure in the upstream compression chamber exceeds the pressure in the downstream compression chamber, and to move towards the closing position when the pressure in the downstream compression chamber exceeds the pressure in the upstream compression chamber.

According to another embodiment of the invention, the sealing surface is elongated and extends along at least a part of the length of the first spiral wrap.

According to another embodiment of the invention, the sealing surface has a rounded and convex cross section.

According to another embodiment of the invention, the sealing device includes at least one reinforcement member.

According to an embodiment of the invention, the at least one reinforcement member is metallic, and is for example made in steel.

According to an embodiment of the invention, the at least one reinforcement member extends along at least a part of the length of the sealing device.

According to another embodiment of the invention, the sealing device includes a sealing lip having the sealing surface, the sealing lip being resiliently deformable between a closing position in which the sealing surface sealingly cooperates with the second base plate and an opening position in which the sealing lip is distant from the second base plate.

According to an embodiment of the invention, the sealing lip is configured to be resiliently deformed towards the opening position when the pressure in the upstream compression chamber exceeds the pressure in the downstream compression chamber, and to be resiliently deformed towards the closing position when the pressure in the downstream compression chamber exceeds the pressure in the upstream compression chamber.

According to another embodiment of the invention, the end face of the first spiral wrap includes a receiving groove extending along at least a part of the length of the first spiral wrap, the sealing device being arranged in the receiving groove.

According to an embodiment of the invention, the sealing device extends substantially along the entire length of the receiving groove.

According to another embodiment of the invention, the sealing device is slidably mounted in the receiving groove between a closing position in which the sealing surface sealingly cooperates with the second base plate and an opening position in which the sealing surface is distant from the second base plate.

According to an embodiment of the invention, the sealing device is configured to move towards the opening position when the pressure in the upstream compression chamber exceeds the pressure in the downstream compression chamber, and to move towards the closing position when the pressure in the downstream compression chamber exceeds the pressure in the upstream compression chamber.

According to an embodiment of the invention, the sealing device is inclined with respect to an orbiting axis of the at least one of the first and second scroll elements.

According to an embodiment of the invention, the sealing device is fitted, and advantageously firmly fitted, into the receiving groove.

According to an embodiment of the invention, the sealing device is sealingly fitted into the receiving groove.

According to an embodiment of the invention, the sealing device includes a support portion, advantageously an elongated support portion, arranged in the receiving groove, the sealing lip extending from and along the support portion.

According to an embodiment of the invention, the sealing lip protrudes from the receiving groove by a protruding distance which is advantageously larger than an axial gap formed between the first and second scroll elements.

According to an embodiment of the invention, a clearance gap is defined by the receiving groove and the sealing device.

According to an embodiment of the invention, the receiving groove includes a first side wall and a second side wall opposite to the first side wall, the sealing device including a first side face configured to slide on the first side wall, and a second side face opposite to the first side face, the second side face and the second side wall defining a clearance gap.

Advantageously, the second side face of the sealing device is oriented towards a center portion of the first and second scroll elements. In other words, the first side face of the sealing device is oriented towards an upstream compression chamber, and the second side face of the sealing device is oriented towards a downstream compression chamber.

According to an embodiment of the invention, the second side face includes a substantially flat surface extending substantially parallely to the orbiting axis of the at least one of the first and second scroll elements, the substantially flat surface being at least partially located outside the receiving groove when the sealing surface is in the closing position.

According to another embodiment of the invention, the sealing device has a spiral shape.

According to an embodiment of the invention, the sealing surface has a spiral shape.

According to an embodiment of the invention, the sealing lip has a spiral shape.

According to an embodiment of the invention, the sealing device has a spiral shaped sealing member having the sealing surface. The spiral-shaped sealing member may include the sealing lip.

According to another embodiment of the invention, the sealing device is in one piece.

According to another embodiment of the invention, the sealing device includes a plurality of sealing members each including a sealing surface configured to cooperate with the second base plate of the second scroll element.

According to an embodiment of the invention, the sealing members are arranged in an abutting manner.

According to an embodiment of the invention, each sealing member includes a sealing lip. For example, the sealing lips of at least two adjacent sealing members of said plurality overlap.

According to an embodiment of the invention, the scroll compression device further includes a discharge port formed at a center portion of the first and second scroll elements, each compression chamber having a variable compression volume decreasing towards the discharge port.

According to an embodiment of the invention, the scroll compression device further includes a sealing device arranged in an end face of the second spiral wrap of the second scroll element and having a sealing surface configured to cooperate with the first base plate of the first scroll element, the sealing device, arranged in an end face of the second spiral wrap, being configured to allow fluid flow from an upstream compression chamber to a downstream compression chamber through the respective sealing surface when the pressure in the upstream compression chamber exceeds the pressure in the downstream compression chamber, and the sealing device, arranged in an end face of the second spiral wrap, being configured to prevent fluid flow from a downstream compression chamber to an upstream compression chamber through the respective sealing surface when the pressure in the downstream compression chamber exceeds the pressure in the upstream compression chamber.

According to another embodiment of the invention, the end face of the second spiral wrap includes a receiving groove extending along at least a part of the length of the second spiral wrap, the sealing device provided on the second spiral wrap being arranged in the respective receiving groove.

The present invention also relates to a scroll compressor including a scroll compression device according to any one of claims 1 to 11, and a drive shaft connected to the at least one of the first and second scroll elements and configured to drive the at least one of the first and second scroll elements in an orbiting movement.

According to an embodiment of the invention, the sealing surface extends from an outer point adjacent to an outer end portion of the first spiral wrap to an inner point adjacent to an inner end portion of the first spiral wrap.

According to an embodiment of the invention, the sealing surface extends along at least 30% of the length of the first spiral wrap, and for example along at least 60% of the length of the first spiral wrap.

According to an embodiment of the invention, the sealing surface extends from an outermost compression chamber to an innermost compression chamber, i.e. a central compression chamber.

These and other advantages will become apparent upon reading the following description in view of the drawing attached hereto representing, as non-limiting examples, several embodiments of a scroll compression device according to the invention.

BRIEF DESCRIPTION OF THE DRAWINGS

The following detailed description of several embodiments of the invention is better understood when read in conjunction with the appended drawings being understood, however, that the invention is not limited to the specific embodiment disclosed.

DETAILED DESCRIPTION

Figure 1:
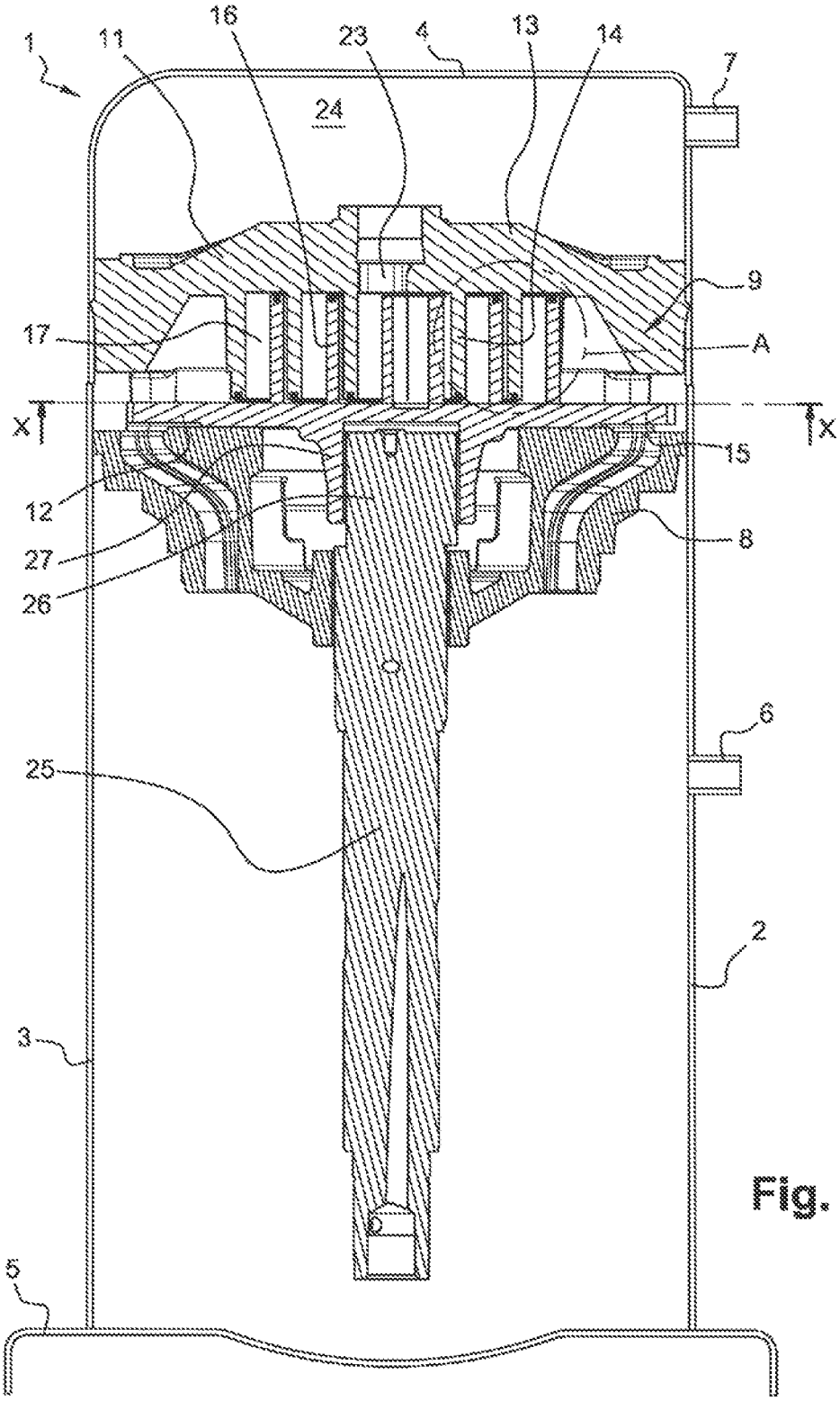
FIG. 1 is a partial and longitudinal section view of a scroll compressor including a scroll compression device according to a first embodiment of the invention.

FIG. 1 shows a scroll compressor 1 including a hermetic casing 2 having a generally cylindrical shell 3, a cap 4 fixed at an upper end of the generally cylindrical shell 3, and a base 5 fixed at a lower end of the generally cylindrical shell 3. The generally cylindrical shell 3 is provided with a suction inlet 6 configured to supply the scroll compressor 1 with refrigerant to be compressed, and the cap 4 is provided with a discharge outlet 7 configured to discharge compressed refrigerant.

The scroll compressor 1 further includes a support member 8, also named crankcase, fixed to the hermetic casing 2, and a scroll compression device 9 disposed inside the hermetic casing 2 and supported by the support member 8. The scroll compression device 9 is configured to compress the refrigerant supplied through the suction inlet 6. The scroll compression device 9 includes a fixed scroll element 11 and an orbiting scroll element 12.

The fixed scroll element 11 includes a base plate 13 and a spiral wrap 14 projecting from the base plate 13 towards the orbiting scroll element 12. The spiral wrap 14 includes an inner face 14.1 directed towards a center portion of the base plate 13, and an outer face 14.2 opposite to the inner face 14.1 and directed towards the outer periphery of the base plate 13.

The orbiting scroll element 12 includes a base plate 15 slidably mounted on the support member 8, and a spiral wrap 16 projecting from the base plate 15 towards the fixed scroll element 11. The spiral wrap 16 includes an inner face 16.1 directed towards a center portion of the base plate 15, and an outer face 16.2 opposite to the inner face 16.1 and directed towards the outer periphery of the base plate 15.

The spiral wrap 16 of the orbiting scroll element 12 meshes with the spiral wrap 14 of the fixed scroll element 11 to form a plurality of compression chambers 17 (see also numerical references 17.1 to 17.4 on FIG. 2) between them. Each of the compression chambers 17 has a variable compression volume which decreases from the outside towards the inside, i.e. inwardly towards a center portion of the fixed and orbiting scroll elements 11, 12, when the orbiting scroll element 12 is driven to orbit relative to the fixed scroll element 11. Each compression chambers 17 is inwardly delimited by the outer face of the spiral warp 14 or of the spiral wrap 16, and is outwardly delimited by the inner face of the spiral warp 14 or of the spiral wrap 16.

The fixed scroll element 11 includes a receiving groove 18 provided on the end face 19, also named tip face, of the spiral wrap 14 and extending along a part of the length of the spiral wrap 14. According to the embodiment shown on FIGS. 1 to 10, the receiving groove 18 extends from an outer point adjacent to an outer end portion of the spiral wrap 14 to an inner point situated near an inner end portion of the spiral wrap 14. The receiving groove 18 may extend along at least 30%, and for example at least 60% or at least 70%, of the length of the spiral wrap 14.

The orbiting scroll element 12 also includes a receiving groove 21 provided on the end face 22 of the spiral wrap 16 and extending along a part of the length of the spiral wrap 16. According to the embodiment shown on FIGS. 1 to 10, the receiving groove 21 extends from an outer point adjacent to an outer end portion of the spiral wrap 16 to an inner point situated near an inner end portion of the spiral wrap 16. The receiving groove 21 may extend along at least 70%, and for example at least 80%, of the length of the spiral wrap 16.

The scroll compression device 9 further includes a discharge port 23 provided at a central portion of the base plate 13 of the fixed scroll element 11, and configured for discharging compressed refrigerant from the compression chambers 17 into a high pressure volume 24 defined by the cap 4. Particularly, the compression volume of each compression chamber 17 decreases towards the discharge port 23.

Furthermore the scroll compressor 1 includes a drive shaft 25 adapted for driving the orbiting scroll element 12 in orbital movements relative to the fixed scroll element 11. Particularly the drive shaft 25 has, at its upper end, an eccentric driving portion 26 received in a cylindrical hub 27 protruding from the lower face of the orbiting scroll element 12.

The scroll compressor 1 also includes two sealing devices 28, 29 respectively arranged in the receiving grooves 18, 21, and extending respectively substantially along the entire length of the respective receiving groove 18, 21. As better shown on FIG. 3, each sealing device 28, 29 is made in one piece and has a spiral shape. Each sealing device 28, 29 could be made for example in rubber or in elastomeric material. The sealing devices 28, 29 are particularly configured to axially seal the compressions chambers 17 respectively between the tip face of the spiral wrap of the respective scroll element and the base plate of the other scroll element.

Figure 2:
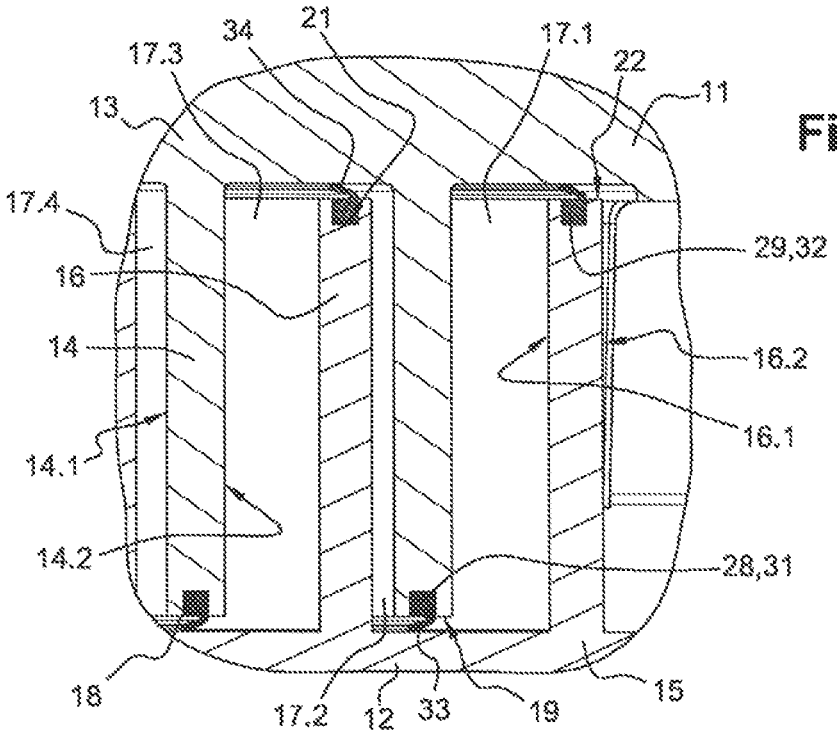
FIG. 2 is an enlarge view of the detail A of FIG. 1.
Figure 3:
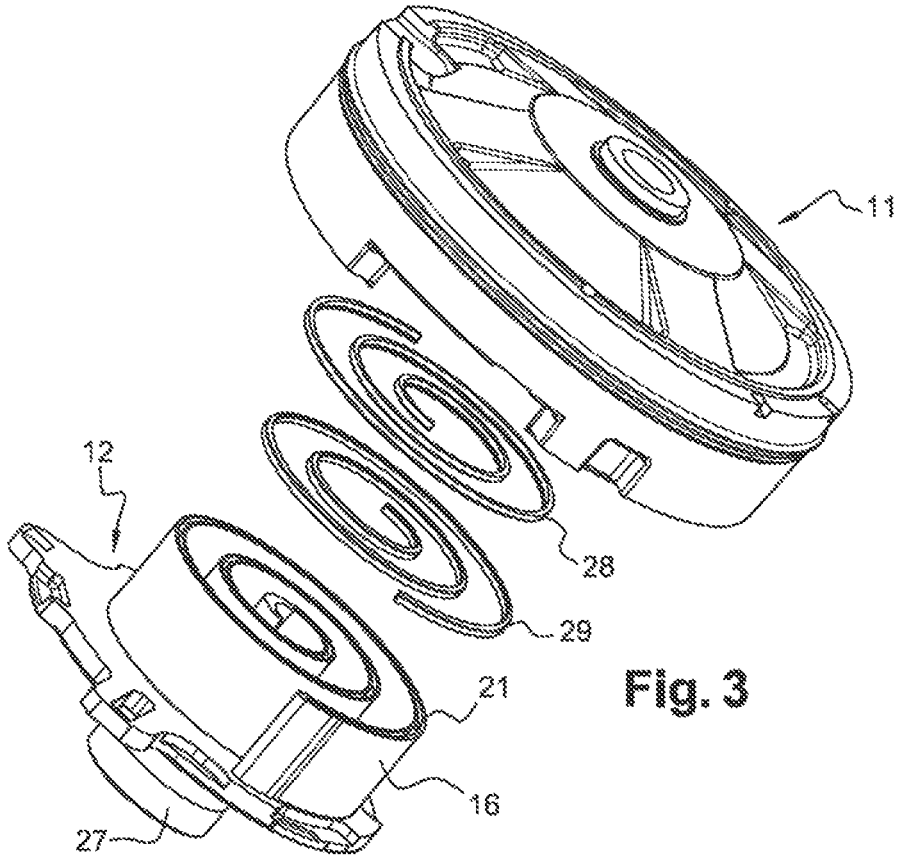
FIG. 3 is an exploded perspective view of the scroll compression device of FIG. 1.
Figure 4:
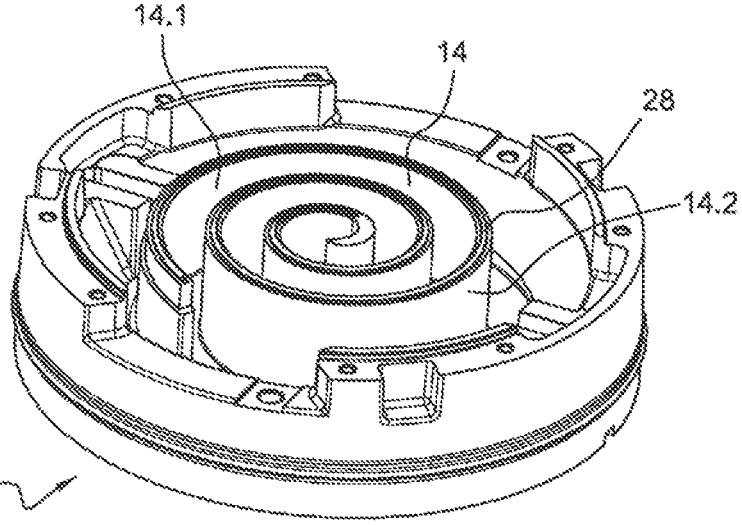
FIG. 4 is a bottom view of a fixed scroll element of the scroll compression device of FIG. 1.
Figure 5:
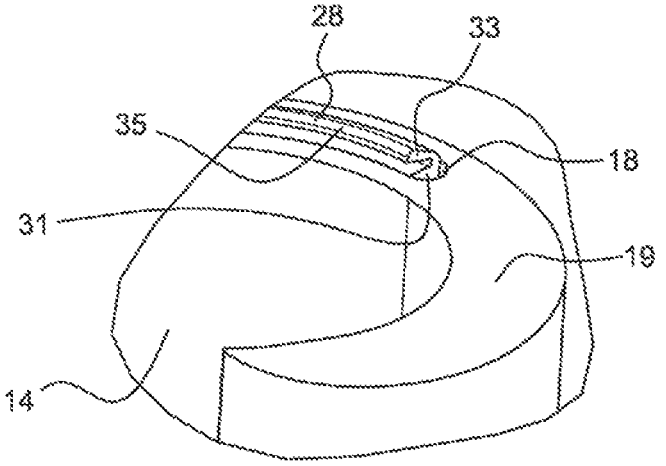
FIG. 5 is an enlarge view of a detail of FIG. 4.
Figure 6:
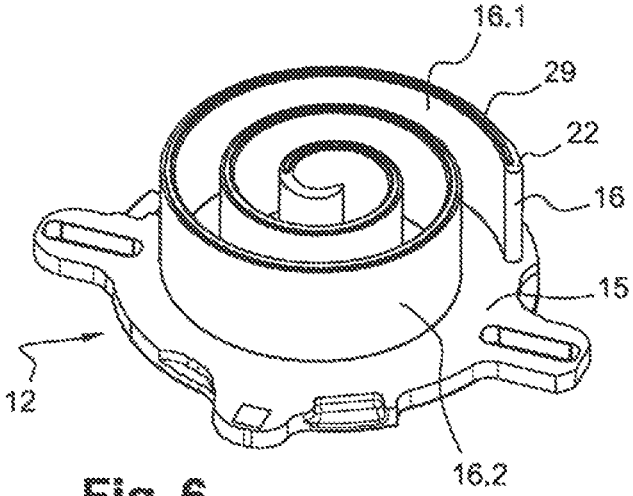
FIG. 6 is a top view of an orbiting scroll element of the scroll compression device of FIG. 1.
Figure 7:
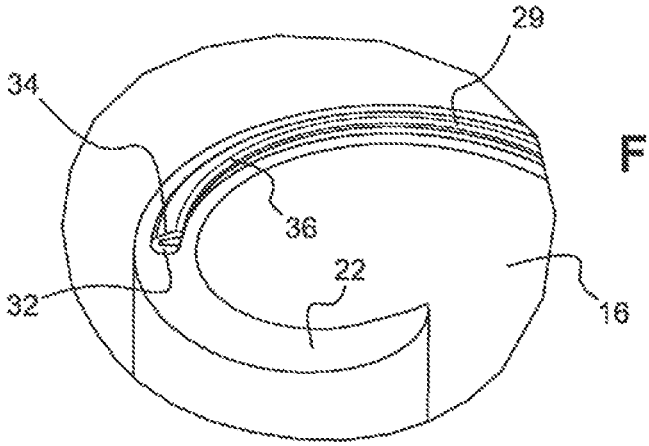
FIG. 7 is an enlarge view of a detail of FIG. 6.
Figure 8:
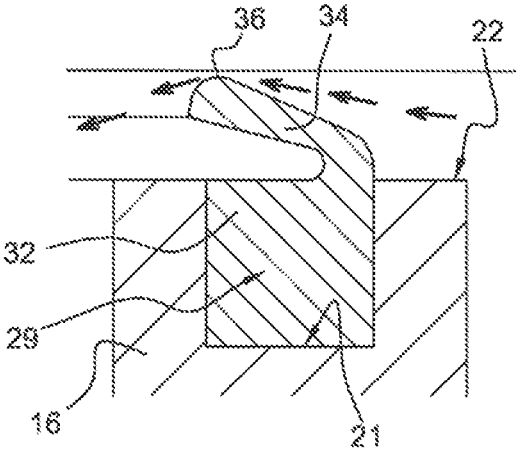
FIGS. 8 and 9 is an enlarge views of sealing devices of the scroll compression device of FIG. 1, showing the sealing devices in opening positions.
Figure 9:
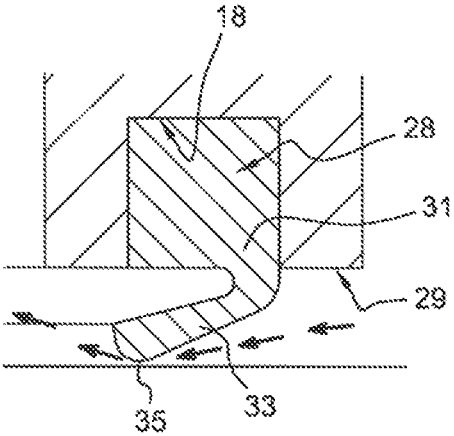
Figure 10:
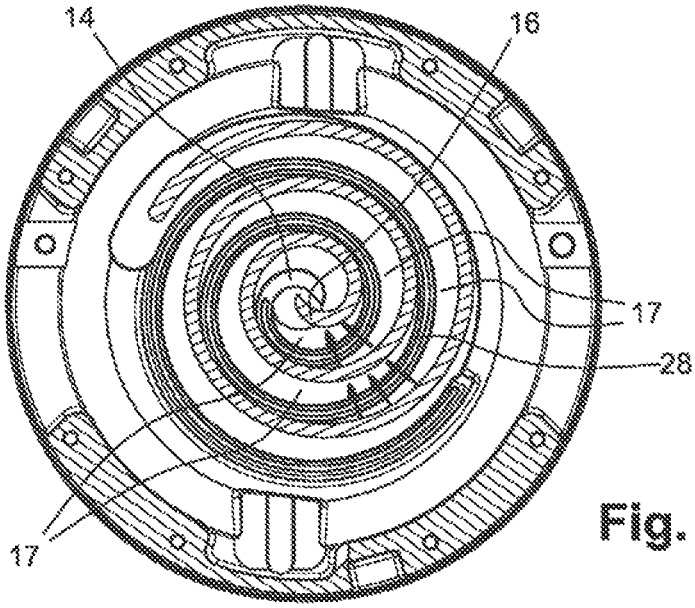
FIG. 10 is a cross section view of the scroll compressor device of FIG. 1.

As better shown on FIGS. 2, 5 and 7, each sealing devices 28, 29 includes a support portion 31, 32 having a spiral shape and being firmly and sealingly fitted in the respective receiving groove 18, 21. Each sealing device 28, 29 further includes a sealing lip 33, 34 having a spiral shape and extending from and along the whole length of the respective support portion 31, 32. Each sealing lip 33, 34 has an elongated sealing surface 35, 36. According to the embodiment shown on FIGS. 1 to 10, each sealing surface 35, 36 has a rounded and convex cross section. However, each sealing surface 35, 36 may have another shape, and may for example have a sharp edge.

The sealing lip 33 of the sealing device 28 is resiliently deformable between a closing position (see FIG. 2) in which the sealing surface 35 sealingly cooperates with the base plate 15 of the orbiting scroll element 12 (i.e. provides a resilient sealing pressure against the base plate 15 of the orbiting scroll element 12), and an opening position (see FIG. 9) in which the sealing lip 33 is distant from the base plate 15. Similarly, the sealing lip 34 of the sealing device 29 is resiliently deformable between a closing position (see FIG. 2) in which the sealing surface 36 sealingly cooperates with the base plate 13 of the fixed scroll element 11 (i.e. provides a resilient sealing pressure against the base plate 13 of the fixed scroll element 11), and an opening position (see FIG. 8) in which the sealing lip 34 is distant from the base plate 13.

The sealing lip 33 is configured to be resiliently deformed towards its opening position when the pressure in a compression chamber (for example compression chamber 17.1 on FIG. 2) located upstream the sealing lip 33 and adjacent to the sealing lip 33 (i.e. in a compression chamber 17 inwardly defined by the outer face 14.2 of the spiral warp 14) exceeds the pressure in a compression chamber (for example compression chamber 17.2 on FIG. 2) located downstream the sealing lip 33 and adjacent to the sealing lip 33 (i.e. in a compression chamber 17 outwardly defined by the inner face 14.1 of the spiral warp 14), and to be resiliently deformed towards the closing position when the pressure in a compression chamber (for example compression chamber 17.4 on FIG. 2) located downstream the sealing lip 33 and adjacent to the sealing lip 33 exceeds the pressure in a compression chamber (for example compression chamber 17.3 on FIG. 2) located upstream the sealing lip 33 and adjacent to the sealing lip 33.

However, as according to the embodiment shown on FIGS. 1 to 10, the sealing lip 33 extends along substantially the whole length of the spiral wrap 14, the sealing lip 33 simultaneously partially delimits several compression chambers 17. Therefore, for example, a first portion of the sealing lip 33 could be resiliently deformed towards the opening position while a second portion of the sealing lip 33 could be resiliently deformed towards the closing position.

Similarly the sealing lip 34 is configured to be resiliently deformed towards its opening position when the pressure in a compression chamber (for example compression chamber 17.2 on FIG. 2) located upstream the sealing lip 34 and adjacent to the sealing lip 34 (i.e. in a compression chamber 17 inwardly defined by the outer face 16.2 of the spiral warp 16) exceeds the pressure in a compression chamber (for example compression chamber 17.3 on FIG. 2) located downstream the sealing lip 34 and adjacent to the sealing lip 34 (i.e. in a compression chamber 17 outwardly defined by the inner face 16.1 of the spiral warp 16), and to be resiliently deformed towards the closing position when the pressure in a compression chamber (for example compression chamber 17.3 on FIG. 2) located downstream the sealing lip 34 and adjacent to the sealing lip 34 exceeds the pressure in a compression chamber (for example compression chamber 17.2 on FIG. 2) located upstream the sealing lip 34 and adjacent to the sealing lip 34.

As according to the embodiment shown on FIGS. 1 to 10, the sealing lip 34 extends along substantially the whole length of the spiral wrap 16, the sealing lip 34 simultaneously partially delimits several compression chambers 17. Therefore, for example, a first portion of the sealing lip 34 could be resiliently deformed towards the opening position while a second portion of the sealing lip 34 could be resiliently deformed towards the closing position.

Consequently, the sealing device 28 is configured to allow fluid flow from an upstream compression chamber to a downstream compression chamber through the sealing surface 35 (and thus along a flow direction extending inwardly, i.e. towards the center portion of the fixed and orbiting scroll elements 11, 12) when the pressure in the upstream compression chamber exceeds the pressure in the downstream compression chamber, and to prevent fluid flow from a downstream compression chamber to an upstream compression chamber through the sealing surface 35 when the pressure in the downstream compression chamber exceeds the pressure in the upstream compression chamber.

Similarly the sealing device 29 is configured to allow fluid flow from an upstream compression chamber to a downstream compression chamber through the sealing surface 36 (and thus along a flow direction extending inwardly, i.e. towards the center portion of the fixed and orbiting scroll elements 11, 12) when the pressure in the upstream compression chamber exceeds the pressure in the downstream compression chamber, and to prevent fluid flow from a downstream compression chamber to an upstream compression chamber through the sealing surface 36 when the pressure in the downstream compression chamber exceeds the pressure in the upstream compression chamber.

Such a configuration of the sealing devices 28, 29 ensures a leakage of the refrigerant from an upstream compression chamber to a downstream compression chamber when the pressure in the upstream compression chamber exceeds the pressure in the downstream compression chamber, and thus allows, on the one hand, to adjust the compression rate, i.e. the pressure ratio, of the scroll compression device and, on the other hand, to avoid an overcompression of the refrigerant, without adjusting the displacement of the scroll compression device.

Figure 11:
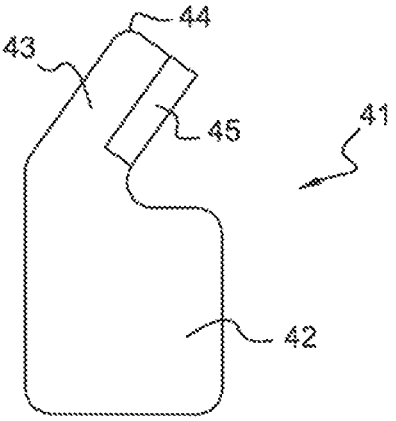
FIG. 11 is a cross section view of a sealing device of a scroll compression device according to a second embodiment of the invention.

FIG. 11 represents a sealing device 41 of a scroll compression device according to a second embodiment of the invention. As the sealing devices 28, 29, the sealing device 41 includes a support portion 42 and a sealing lip 43 having a sealing surface 44. However the sealing device 41 differs from the sealing devices 28, 29 in that it includes a reinforcement member 45 which may extend along a part of the length or the whole length of the sealing lip 43. The reinforcement member 45 is advantageously metallic, and could be made for example in steel.

Figure 12:
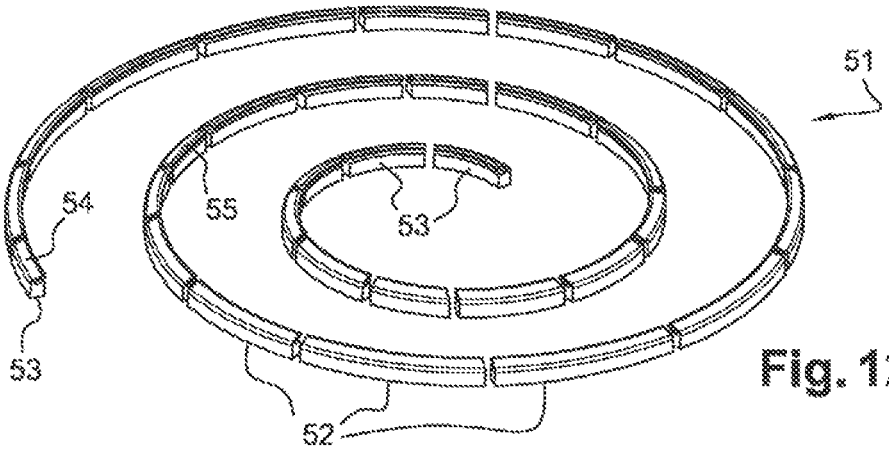
FIG. 12 is a perspective view of a sealing device of a scroll compression device according to a third embodiment of the invention.

FIG. 12 represents a sealing device 51 of a scroll compression device according to a third embodiment of the invention. The sealing device 51 differs from the sealing devices 28, 29 essentially in that it includes a plurality of sealing members 52, each sealing member 52 including a support portion 53 and a sealing lip 54 having a sealing surface 55. Advantageously, the sealing members 52 are arranged in an abutting manner in the respective receiving groove. For example, the sealing lips 54 of each pair of adjacent sealing members 52 may overlap.

Figure 13:
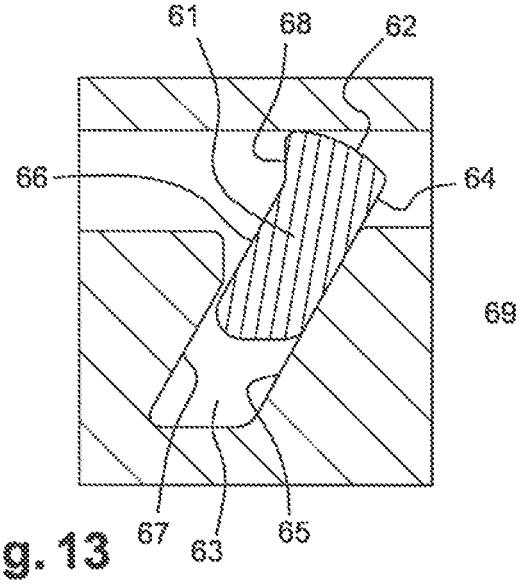
FIGS. 13 and 14 are cross section views of a sealing device of a scroll compression device according to a fourth embodiment of the invention.
Figure 14:
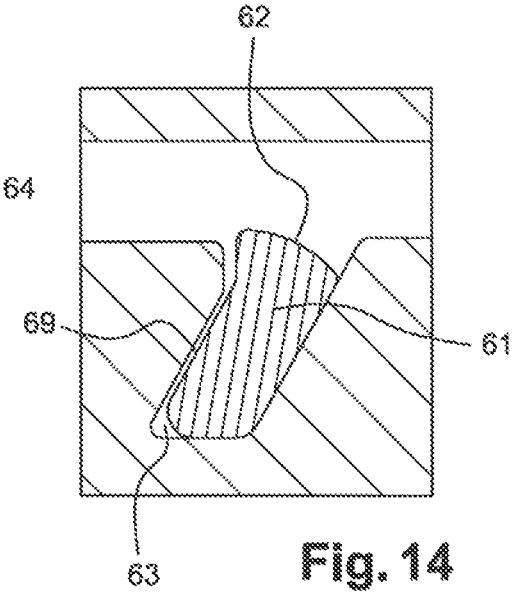

FIGS. 13 and 14 represent a sealing device 61 of a scroll compression device according to a fourth embodiment of the invention. As the sealing devices 28, 29, the sealing device 61 includes a sealing surface 62. However the sealing device 61 differs from the sealing devices 28, 29 essentially in that it is slidably mounted in the respective receiving groove 63 between a closing position (see FIG. 13) in which the sealing surface 62 sealingly cooperates with the respective base plate and an opening position (see FIG. 14) in which the sealing surface 62 is distant from the respective base plate.

According to said fourth embodiment of the invention, the sealing device 61 is inclined with respect to the orbiting axis of the orbiting scroll element 12, and includes an outer face 64 configured to slide on a first side wall 65 of the respective receiving groove 63, and an inner face 66 opposite to the outer face 64 and facing a second side wall 67 of the receiving groove 63. The outer face 64 of the sealing device 61 is directed towards an upstream compression chamber 17, while the inner side face 66 of the sealing device 61 is directed towards a downstream compression chamber 17. As better shown on FIG. 14, the sealing device 61 and the receiving groove 63 define a clearance gap 69.

Advantageously, the outer face 66 of the sealing device 61 includes a substantially flat surface 68 extending parallely to the orbiting axis of the orbiting scroll element 12, and configured to be located outside the respective receiving groove 63 when the respective sealing surface 62 is in the closing position.

According to said fourth embodiment of the invention, the sealing device 61 is configured to move towards the opening position when the pressure in a compression chamber located upstream the sealing device 61 and adjacent to the sealing device 61 (i.e. in a compression chamber 17 inwardly defined by the outer face of the spiral warp 14 or of the spiral wrap 16) exceeds the pressure in a compression chamber located downstream the sealing device 61 and adjacent to the sealing device 61 (i.e. in a compression chamber 17 outwardly defined by the inner face of the spiral warp 14 or of the spiral wrap 16), and to move towards the closing position when the pressure in the downstream compression chamber exceeds the pressure in the upstream compression chamber.

Of course, the invention is not restricted to the embodiments described above by way of non-limiting examples, but on the contrary it encompasses all embodiments thereof.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A scroll compression device including at least:

a first scroll element having a first base plate and a first spiral wrap extending from the first base plate, a second scroll element having a second base plate and a second spiral wrap extending from the second base plate, at least one of the first and second scroll elements being configured to perform an orbiting movement in relation to the other one of the first and second scroll elements, the first and second scroll elements intermeshing with each other and delimiting compression chambers, a sealing device arranged in an end face of the first spiral wrap of the first scroll element and having a sealing surface configured to cooperate with the second base plate of the second scroll element, wherein the sealing device is configured to allow fluid flow from an upstream compression chamber to a downstream compression chamber through the sealing surface when the pressure in the upstream compression chamber exceeds the pressure in the downstream compression chamber, and the sealing device is configured to prevent fluid flow from a downstream compression chamber to an upstream compression chamber through the sealing surface when the pressure in the downstream compression chamber exceeds the pressure in the upstream compression chamber.

2. The scroll compression device according to claim 1, wherein the sealing surface is movable between a closing position in which the sealing surface sealingly cooperates with the second base plate and an opening position in which the sealing surface is distant from the second base plate, the sealing surface being configured to move towards the opening position when the pressure in the upstream compression chamber exceeds the pressure in the downstream compression chamber, and to move towards the closing position when the pressure in the downstream compression chamber exceeds the pressure in the upstream compression chamber.

3. The scroll compression device according to claim 2, wherein the sealing surface is elongated and extends along at least a part of the length of the first spiral wrap.

4. The scroll compression device according to claim 2, wherein the sealing surface has a rounded and convex cross section.

5. The scroll compression device according to claim 2, wherein the sealing device includes at least one reinforcement member.

6. The scroll compression device according to claim 1, wherein the sealing surface is elongated and extends along at least a part of the length of the first spiral wrap.

7. The scroll compression device according to claim 6, wherein the sealing surface extends along at least 30% of the length of the first spiral wrap.

8. The scroll compression device according to claim 7, wherein the sealing surface has a rounded and convex cross section.

9. The scroll compression device according to claim 6, wherein the sealing surface has a rounded and convex cross section.

10. The scroll compression device according to claim 6, wherein the sealing device includes at least one reinforcement member.

11. The scroll compression device according to claim 1, wherein the sealing surface has a rounded and convex cross section.

12. The scroll compression device according to claim 1, wherein the sealing device includes at least one reinforcement member.

13. The scroll compression device according to claim 1, wherein the end face of the first spiral wrap includes a receiving groove extending along at least a part of the length of the first spiral wrap, the sealing device being arranged in the receiving groove.

14. The scroll compression device according to claim 13, wherein the sealing device is slidably mounted in the receiving groove between a closing position in which the sealing surface sealingly cooperates with the second base plate and an opening position in which the sealing surface is distant from the second base plate.

15. The scroll compression device according to claim 1, wherein the sealing device includes a sealing lip having the sealing surface, the sealing lip being resiliently deformable between a closing position in which the sealing surface sealingly cooperates with the second base plate and an opening position in which the sealing lip is distant from the second base plate.

16. The scroll compression device according to claim 1, wherein the sealing device has a spiral shape.

17. The scroll compression device according to claim 1, wherein the sealing device is in one piece.

18. The scroll compression device according to claim 1, wherein the sealing device includes a plurality of sealing members each including a sealing surface configured to cooperate with the second base plate of the second scroll element.

19. The scroll compression device according to claim 1, further including a sealing device arranged in an end face of the second spiral wrap of the second scroll element and having a sealing surface configured to cooperate with the first base plate of the first scroll element, the sealing device, arranged in an end face of the second spiral wrap, is configured to allow fluid flow from an upstream compression chamber to a downstream compression chamber through the respective sealing surface when the pressure in the upstream compression chamber exceeds the pressure in the downstream compression chamber, and the sealing device, arranged in an end face of the second spiral wrap, is configured to prevent fluid flow from a downstream compression chamber to an upstream compression chamber through the respective sealing surface when the pressure in the downstream compression chamber exceeds the pressure in the upstream compression chamber.

20. A scroll compressor including a scroll compression device according to claim 1, and a drive shaft connected to the at least one of the first and second scroll elements and configured to drive the at least one of the first and second scroll elements in an orbiting movement.

* * * * *